US005161731A

United States Patent [19]

Rivlin et al.

[11] Patent Number: 5,161,731

[45] Date of Patent: Nov. 10, 1992

[54] REINFORCED EXPANDABLE FOLDER

[75] Inventors: Jonathan B. Rivlin, East Brunswick, N.J.; Lee A. Boy, Staten Island, N.Y.; Setsuo Kanamoto, Montebello, Calif.; Eric R. Aaldenberg, Bayside, N.Y.; John Heffernan, Setauket, N.Y.

[73] Assignee: Esselte Pendaflex Corporation, Garden City, N.Y.

[21] Appl. No.: 748,291

[22] Filed: Aug. 21, 1991

[51] Int. Cl.[5] ..... B65D 27/00

[52] U.S. Cl. ..... 229/1.5 R; 383/119; 383/120

[58] Field of Search ..... 229/1.5 R, 72, DIG. 3; 383/119, 120

[56] References Cited

U.S. PATENT DOCUMENTS

| | | | |
|---|---|---|---|
| 282,275 | 7/1883 | Cooke | 229/72 X |
| 325,676 | 9/1885 | Jenkins | 229/72 X |
| 510,350 | 12/1893 | Lochmann | 229/72 X |
| 574,974 | 1/1897 | Wiley . | |
| 821,019 | 5/1906 | Cooke . | |
| 1,116,383 | 11/1914 | Case . | |
| 1,150,034 | 8/1915 | Hub . | |
| 1,273,960 | 7/1918 | Wagemaker . | |
| 1,455,419 | 5/1923 | Ahlquist . | |
| 1,585,237 | 5/1926 | Doughty | 229/68 R |
| 1,622,753 | 3/1927 | Ahlquist . | |
| 1,634,450 | 7/1927 | Bushnell . | |
| 1,650,051 | 11/1927 | Smith . | |
| 1,698,841 | 1/1929 | Doughty . | |
| 1,743,191 | 1/1930 | Charlton . | |
| 1,745,249 | 1/1930 | Doughty . | |
| 1,757,122 | 5/1930 | Hunter . | |
| 1,802,429 | 4/1931 | Josephson . | |
| 1,868,188 | 7/1932 | Barker . | |

(List continued on next page.)

FOREIGN PATENT DOCUMENTS

| | | | |
|---|---|---|---|
| 1216486 | 1/1987 | Canada . | |
| 0001167 | 3/1979 | European Pat. Off. . | |
| 891985 | 10/1953 | Fed. Rep. of Germany . | |
| 3009430 | 9/1981 | Fed. Rep. of Germany . | |
| 3047230 | 7/1982 | Fed. Rep. of Germany . | |
| 2278500 | 2/1976 | France . | |
| 2300685 | 9/1976 | France . | |
| 2477504 | 9/1981 | France . | |
| 2623749 | 6/1989 | France . | |
| 141053 | 9/1930 | Switzerland . | |
| 426225 | 1/1935 | United Kingdom | 229/72 |
| 1123130 | 8/1968 | United Kingdom . | |

*Primary Examiner*—Stephen P. Garbe
*Assistant Examiner*—Jes F. Pascua
*Attorney, Agent, or Firm*—Pennie & Edmonds

[57] ABSTRACT

An expandable folder is provided which includes a front panel member, a rear panel member, and a gusset member which connects peripheral portions of the bottoms of the front and rear panel members and at least a portion of the sides of the panel members to form the expandable folder. The gusset member includes a sheet having a plurality of accordion-like folds, with terminal folds of the sheet being wider than the other folds, and the terminal folds are connected to the front and rear panel members to enhance the connection therebetween. The expandable folder further comprises interior reinforcing strips positioned along at least part of the connection between the gusset member and panel members peripheral portion for preventing separation of the front and rear panel members from the gusset member when the folder is used. Reinforcing strips may also be provided along the top or corners of the gusset member or on outer peripheral portions of the panel members. In addition, the outer surfaces of the panel members may be coated with a polymer to increase the resistance of the folder to water penetration and to protect the folder from disfigurement.

43 Claims, 3 Drawing Sheets

U.S. PATENT DOCUMENTS

| | | | |
|---|---|---|---|
| 1,891,558 | 12/1932 | Rupf . | |
| 1,956,325 | 4/1934 | Hart . | |
| 2,052,623 | 9/1936 | Harby | 93/1 |
| 2,062,436 | 12/1936 | Yawman | 129/16.8 |
| 2,188,730 | 1/1940 | Swab . | |
| 2,264,295 | 12/1941 | Carter | 129/16.7 |
| 2,291,724 | 8/1942 | Jonas | 129/16.7 |
| 2,304,385 | 12/1942 | Sussman | 281/34 |
| 2,330,402 | 9/1943 | Winokar | 229/72 |
| 2,460,909 | 2/1949 | Shaffer | 229/68 |
| 2,507,659 | 5/1950 | Zalkind | 40/23 |
| 2,519,405 | 8/1950 | Schwinger | 229/72 |
| 2,797,801 | 7/1957 | Bishop | 206/56 |
| 2,893,144 | 7/1959 | Cunningham | 40/23 |
| 3,063,619 | 11/1962 | Rhoten | 229/68 |
| 3,073,508 | 1/1963 | Hiersteiner | 229/68 |
| 3,198,420 | 3/1965 | Heirsteiner | 229/68 |
| 3,238,947 | 3/1966 | Churnick | 129/16.8 |
| 3,245,162 | 4/1966 | McElroy | 40/23 |
| 3,245,859 | 4/1966 | Busk | 156/479 |
| 3,425,145 | 2/1969 | Newton | 40/23 |
| 3,444,635 | 5/1969 | Setzler | 40/2 |
| 3,552,640 | 1/1971 | Young | 229/68 |
| 3,586,160 | 6/1971 | Heimann | 206/56 AB |
| 3,691,662 | 9/1972 | Cunningham | 40/23 A |
| 3,747,242 | 7/1973 | Heimann | 40/2 R |
| 3,779,393 | 12/1973 | Grundell | 211/126 |
| 3,780,460 | 12/1973 | Hurt | 40/78 |
| 3,801,408 | 4/1974 | Kuring et al. | 156/552 |
| 3,805,426 | 4/1974 | Cunningham | 40/2 R |
| 3,863,998 | 2/1975 | Grundell | 312/184 |
| 3,891,070 | 6/1975 | Montanari | 190/41 R |
| 3,933,294 | 1/1976 | Meenan et al. | 229/1.5 R |
| 3,937,493 | 2/1976 | Fasbender | 283/41 |
| 3,978,191 | 8/1976 | Allen et al. | 264/285 |
| 4,031,646 | 6/1977 | de Nouel | 40/359 |
| 4,050,719 | 9/1977 | Cunningham | 283/36 |
| 4,053,057 | 10/1977 | Snowden | 211/126 |
| 4,109,850 | 8/1978 | Meenan et al. | 229/72 |
| 4,175,476 | 11/1979 | Kidd | 93/1 E |
| 4,204,639 | 5/1980 | Barber et al. | 235/462 |
| 4,240,848 | 12/1980 | Barber | 156/64 |
| 4,247,577 | 6/1981 | Walsh | 229/1.5 R |
| 4,284,227 | 8/1981 | Corey | 229/1.5 R |
| 4,329,191 | 5/1982 | Barber | 156/64 |
| 4,400,107 | 8/1983 | Pitts | 402/4 |
| 4,486,261 | 12/1984 | Koller et al. | 156/461 |
| 4,523,776 | 6/1985 | Barber | 283/39 |
| 4,580,815 | 4/1986 | Barber | 283/81 |
| 4,588,463 | 5/1986 | Barber et al. | 156/200 |
| 4,730,727 | 3/1988 | Petroff | 206/311 |
| 4,749,121 | 6/1988 | Barber et al. | 229/1.5 R |
| 4,806,397 | 2/1989 | Horwitz | 229/1.5 R X |
| 4,830,268 | 5/1989 | Pitts | 229/68 R |
| 4,958,728 | 9/1990 | Effendi | 206/44 B |
| 4,966,639 | 10/1990 | Pfeffer et al. | 156/359 |
| 4,971,361 | 11/1990 | Whiting | 281/2 |
| 5,025,979 | 6/1991 | Dellacroce | 229/1.5 R |

REINFORCED EXPANDABLE FOLDER

BACKGROUND OF THE INVENTION

1. Field of the Invention

The present invention relates to paper office supplies, and, in particular, to expandable folders having reinforced sides, corners, and edges for making the file stronger and more durable.

2. Description of the Prior Art

Expandable folders are a necessary tool in the modern office or business and are also used in homes and schools. These folders are typically constructed of rectangular front & rear panel members having accordion-like folds along the sides, commonly called gussets, which allow the folder to expand from front to back. The folders are shipped and stored in their compact state. When put into use they expand gradually as they are filled with documents, papers or other items.

These expandable folders are normally filled with documents until the gussets are completely extended and no additional documents can be placed in the folder. However, filling an expandable folder in this manner often leads to premature failure of the folder due to tearing at certain critical locations. These critical locations are most commonly at the point of intersection of the gusset with the front and rear panel members, at the corners of the folder, along the top edge of the gusset, and in the gusset itself.

Fully expanded folders usually tear at the point of intersection of the gusset with the front and rear panel members because when these expanded folders are subsequently looked through to locate a particular document, the searcher often tries to expand the folder further in order to see and retrieve the documents stored therein. Also, when the retrieved document must be returned to the folder, the searcher will again stretch the folder to make room so that the document may be easily placed therein. However, because the gusset is already fully expanded, the only way for the folder to expand further is for the folder to tear at the point where the gussets are joined to the front and rear panel members of the folder.

A fully expanded folder is also relatively heavy, and this weight contributes to failure of the folder in variety of ways. For instance, the folders are often picked up by only the front or rear panel member, which causes the panel member to completely tear away from the gusset. Further, when a fully expanded folder is repeatedly placed on a desk or tabletop, the rubbing of the corners, sides and bottom of the folder on the tabletop surface causes these areas of the folder to fray or wear away. This fraying and wearing away detracts from the neat appearance the folders should have, further weakens the folder and can cause the loss of small items stored therein. Finally, when a full folder is dropped, the folder will burst or split along the seam between the gusset and front or rear panel members, scattering the folder or contents around the place of impact.

Expandable folders are also normally stored on shelves with their front and rear faces perpendicular to the length of the shelf. When these folders are retrieved, fingers are usually placed over the top edge of the gusset so that the folder can be pulled off the shelf. However, because the fully expanded folder is relatively heavy, pulling the folder in this manner often leads to separation of the gusset from the front and rear panel members. Further, the fingers usually pull the folder from the same place on the gusset over and over again. Over time, dirt and sweat will accumulate on the gusset, thereby fraying and weakening the gusset and causing the gusset to unexpectedly tear when the folder is retrieved.

These folders often become wet during use, either by being exposed to rain or snow during transport from one location to another, or when water or beverages such as coffee, tea, or soda are accidentally spilled on them, or due to moisture in the air when the folder is stored. When these folders become moist or wet, they weaken considerably and are very susceptible to tearing. Further, the wet folders become deformed, weakened and deteriorate rapidly when they become dry, and are also very susceptible to tearing in this condition.

Finally, these folders are often identified by pressure-sensitive adhesive labels attached to the front or rear panel member. However, when it is desired to remove these labels, the folders often become disfigured due to the inability to separate the adhesive on the label from the fibers in the panel members. Thus, these folders are often discarded simply because they no longer have a neat appearance.

The applicants have identified the above problems and have established that a need exists for an expandable folder that solves them. In particular, there is a need for an expandable folder of superior strength that is durable, will not fail when it is filled to capacity, is resistant to liquids, and which will maintain a neat, sturdy appearance.

SUMMARY OF THE INVENTION

In accordance With the present invention there is provided an expandable folder which comprises a front panel member having first and second surfaces, opposed sides and a bottom, a rear panel member having first and second surfaces, opposed sides and a bottom, and a gusset member having a top, bottom, opposed sides, and two corners. The bottom and opposed sides of the gusset member connect peripheral portions of the bottom of the front and rear panel members and at least a portion of the sides thereof so that the first surfaces of the panel members face each other to form front and rear inner boundaries of the folder.

The gusset member comprises a sheet having a plurality of accordion-like folds, with terminal folds of the sheet being wider than the other folds. These terminal folds are connected to the front and rear panel members to enhance the connection therebetween.

Interior reinforcing means may be applied to the first surfaces of the front and rear panel members in order to prevent separation of the front and rear panel members from the gusset members when the folder is used. Preferably, the interior reinforcing means is positioned adjacent to at least part of the connection between the sides of the gusset member and panel member peripheral portions.

Reinforcing means may also be applied to the corners of the gusset member. This reinforcing means extends along the corner and a portion of the side and bottom of the gusset member to enhance the wear resistance of the folder.

Reinforcing means may also be applied along at least one top portion of the gusset member to enhance the tear resistance of the gusset member when the folder is used.

Finally, a coating may also be applied on to the second surfaces of the front and rear panel members to improve the resistance of the folder to penetration by liquids and to prevent disfigurement of the folder due to repeated labeling and relabeling.

The coating and reinforcing means may be applied alone or in combination to impart the desired improvements to the folder. The optimum design includes the combination of all the reinforcing means and the coating.

DETAILED DESCRIPTION OF THE PREFERRED EMBODIMENTS

Figure 2:
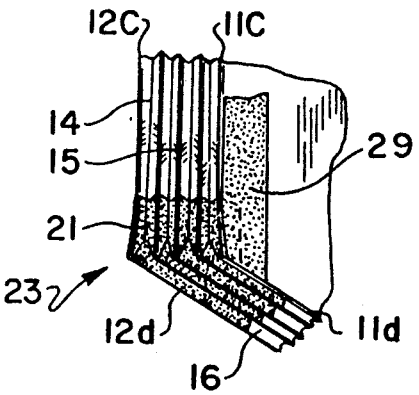
FIG. 2 is a perspective detail view of a bottom corner of the expandable folder of the present invention.
Figure 1:
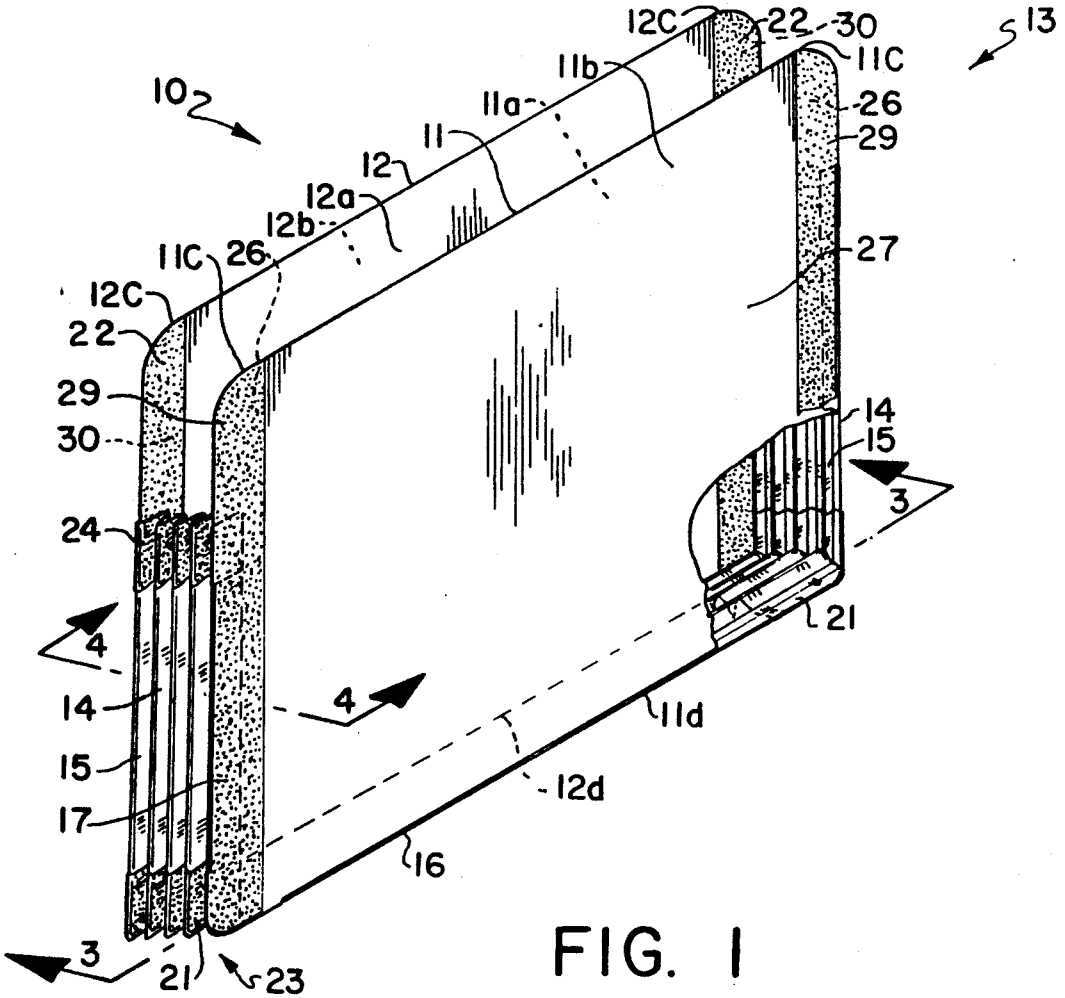
FIG. 1 is a perspective view of the expandable folder of the present invention.
Figure 3:
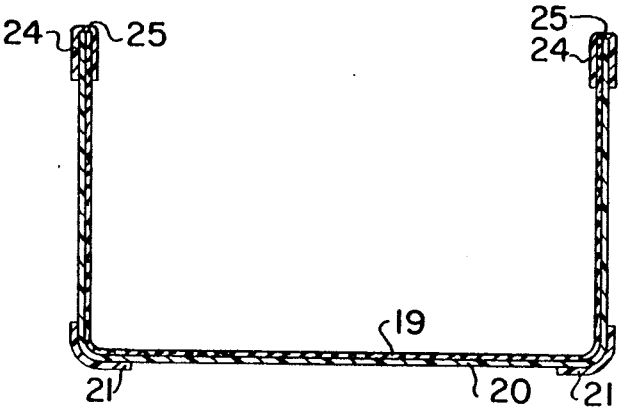
FIG. 3 is a longitudinal section of the gusset of the expandable folder taken along line III—III of FIG. 1.

Referring to the drawings and particularly to FIG. 1, there is illustrated a first embodiment of an expandable folder 10 in accordance with the present invention. Folder 10 comprises a front panel member 11, a rear panel member 12, an open top 13 and connection means between front panel member 11 and rear panel member 12 in the form of a z-folded expandable gusset 14. Gusset 14 forms a portion of the sides 15 and the entire bottom 16 of folder 10.

Front panel member 11 comprises an inner layer **11*a* and an outer layer 11*b* which are cut or stamped from a web 35 of heavy paper or cardboard such as red wallet, red rope, or manila. Inner layer 11*a* and outer layer 11*b* are glued, stamped or otherwise attached to each other to form front panel member 11. Likewise, rear panel member 12 comprises an inner layer 12*a* and an outer layer 12*b* which are cut or stamped from a web 35 of heavy paper or cardboard such as red wallet, red rope or manila. Inner layer 12*a* and outer layer 12*b* are also attached to each other by gluing, stamping, or the like to form rear panel member 12**.

However, before outer layers **12*b*, 12*b* are stamped from web 35, web 35 is preferably treated on one side with a liquid resistant acrylic coating 27. The treated side of web 35 will form the outer surface of outer layers 11*b*, 12*b*, and coating 27 will act to prevent moisture permeation into folder 10. Further, coating 27 will allow for easy labeling and relabeling of folder 10 by preventing the adhesive on the labels from actually contacting the surface of folder 10, thereby preventing disfigurement of folder 10 due to repeated labeling and relabeling. Preferably, coating 27 will be a styrenated acrylic water based emulsion 36**, purchased from Roymal, Inc. of Newport, N.H., which is applied by a flexographic press procedure, as discussed herein.

As shown in FIGS. 3, 4, 5 and 6, gusset 14 comprises a sheet of laminated, flat paper 19 that is repeatedly folded on top of itself to give it an accordion-like expanding capability. Gusset 14 ends in terminal folds 17, 18 which are at least twice as wide as inner folds 28 of gusset 14, or are at least $\frac{7}{8}$ of an inch wide, whichever is greater.

Flat paper 19 is long enough to continuously extend around sides 15 and bottom 16 of folder 10, and is as wide as the desired expanded thickness of expandable folder 10. However, before flat paper 19 is folded into gusset 14, a reinforcing material, preferably Tyvek® or some other water resistant and durable material, is first affixed to flat paper 19. This reinforcing material will provide enhanced strength and resistance to tearing to folder 10, as compared to expandable folders available in the prior art.

A first location for gusset reinforcing material is along the entire length and width on one side of the flat paper 19. This reinforcement will be identified as a reinforcement layer 20. Although reinforcement layer 20 is preferably attached to only the side of flat paper 19 that will become the outer surface of gusset 14, a similar reinforcement layer 20 may also be attached to the other side of the flat paper 19 so that both sides are reinforced. Reinforcement layer 20 will prevent the re-shaping of folds 28 through repeated expansions and contractions of folder 10 and will protect gusset 14 from liquids.

Figure 4:
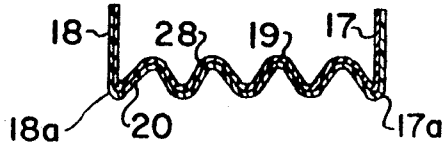
FIG. 4 is a transverse cross section of the gusset taken along line IV—IV of FIG. 1.
Figure 5:
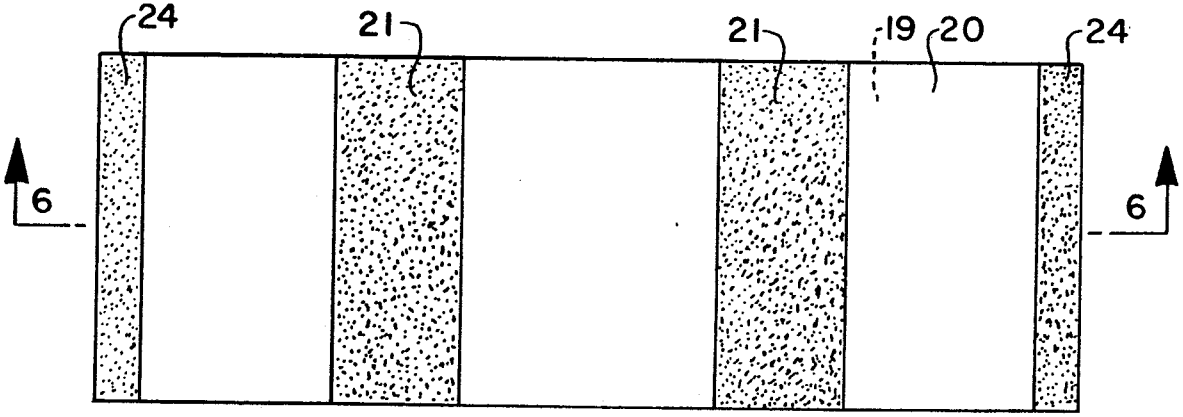
FIG. 5 is a plan view of an unfolded gusset.
Figure 6:
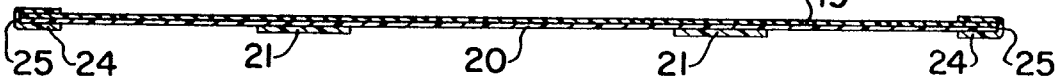
FIG. 6 is a longitudinal section of the gusset taken along line VI—VI of FIG. 5.

A second location for reinforcing material is upon a portion of the reinforcement layer 20 at the locations where corners 23 will subsequently be formed in folder 10. Corners 23 are formed when flat paper 19 is folded to form gusset 14 and gusset 14, in turn, is attached to the periphery of both the front panel member 11 and rear panel member 12. This reinforcement will be referred to as corner strips 21. Preferably, these corner strips 21 extend along the entire width of reinforcement layer 20, as shown in FIG. 4. Corner strips 21, in conjunction with reinforcement layer 20, reinforce and provide exceptional wear resistance to corners 23, as discussed hereinbelow.

A third location for reinforcing material is over the common edge 25 of flat paper 19 and reinforcement layer 20. This reinforcement will be referred to and as edge strip 24. Edge strip 24 is affixed along the entire width of the upper portion of flat paper 19, over common edge 25, and along the entire width of the upper portion of reinforcement layer 20 (see FIGS. 3, 4 and 6). Edge strip 24, in conjunction with coating layer 20, will protect the upper portion of gusset 14 from dirt and moisture and will provide additional resistance tear to gusset 14.

As noted above, the most preferred reinforcement material is a Tyvek® thermoplastic film which includes an adhesive to attach it to panel members 11, 12 or gusset 14. It is possible, however, to use other thermoplastic films or tape to achieve similar results. Also, paper strips, which are glued or otherwise attached to the area to be reinforced, may be used. If so, it is preferred to use a paper material which is treated by a polymer coating or is laminated to a plastic material in order to be resistant to moisture penetration.

Gusset 14 is preferably attached to front panel member 11 and rear panel member 12 by gluing, stamping, or otherwise attaching terminal fold 17 in between inner layer **11*a* and outer layer 11*b* while layers 11*a*, 11*b* are attached to each other, and by gluing, stamping, or otherwise attaching terminal fold 18 in between inner layer 12***a* and outer layer 12*b* while layers 12*a*, 12*b* are attached to each other. Thus, inner layers 11*a*, 12*a* extend to substantially the outermost ends 17*a*, 18*a* of the first and last gusset folds, respectively. It is also contemplated that terminal folds 17, 18 may be attached solely to the interior surfaces of inner layers 11*a*, 12*a*, respectively, or to the exterior surfaces of outer layers 11*b*, 12*b*, respectively. With either method of attachment, terminal fold 17 will be positioned along vertical edges 11*c* and bottom edge 11*d* of front panel member 11, and terminal fold 18 will be position along vertical edges 12*c* and bottom edge 12*d* of rear panel member 12.

As discussed above, terminal folds 17, 18 have an extended width which is at least twice the width of interior folds 28 or at least about ⅞ of an inch, whichever is greater. Thus, the surface area over which gusset 14 is attached to front panel member 11 and rear panel member 12 is very large, as compared with attachment surface areas of prior art folders. Thus, the bond between terminal folds 17, 18 and front panel member 11 and rear panel member 12, respectively, is exceptionally strong. Accordingly, if folder 10 were pulled by gusset 14 in a direction parallel to front panel member 11 or rear panel member 12, gusset 14 would not separate or tear away from front panel member 11 or rear panel member 12 as would gussets of prior art folders.

After folder 10 has been assembled, additional reinforcement is applied to provide even greater strength and tear resistance to folder 10, as compared to prior art expandable folders. This reinforcement is in the form of interior reinforcing strips 26 which are affixed to the exposed surface of inner layer 11*a* from bottom edge lid to top edge 11*e* along vertical edges 11*c*. Likewise, interior reinforcing strips 22 are added to the exposed surface of inner layer 12*a* from bottom edge 12*d* to top edge 12*e* along vertical edges 12*c*. Interior reinforcing strips 22, 26 insure that when folder 10 is stretched after gussets 14 are already fully expanded, i.e. when folder 10 is hyper-expanded, inner layers 11*a*, 12*a* have greater resistance to separation from gusset 14.

Additionally, exterior reinforcing strips 29 are added to the exposed surface of outer layer 11*b* from bottom edge 11*d* to top edge 11*e* along vertical edges 11*c*. Likewise, exterior reinforcing strips 30 are added to the exposed surface of outer layer 12*b* from bottom edge 12*d* to top edge 12*e* along vertical edge 12*c*. Exterior reinforcing strips 29, 30, may provide even greater structural stability and durability to folder 10.

As discussed above, coating 27 is applied to web 35 before outer layers 11*b*, 12*b* of panel members 11, 12, respectively, are formed therefrom by a flexographic printing procedure. Flexographic printing is a well-known form of rotary printing in which aniline inks or layers of other chemicals are applied to various surfaces by means of rubber or other elastomeric plates. Flexographic printing is particularly well suited for applying coating layers 27 on relatively coarse surfaces.

Figure 7:
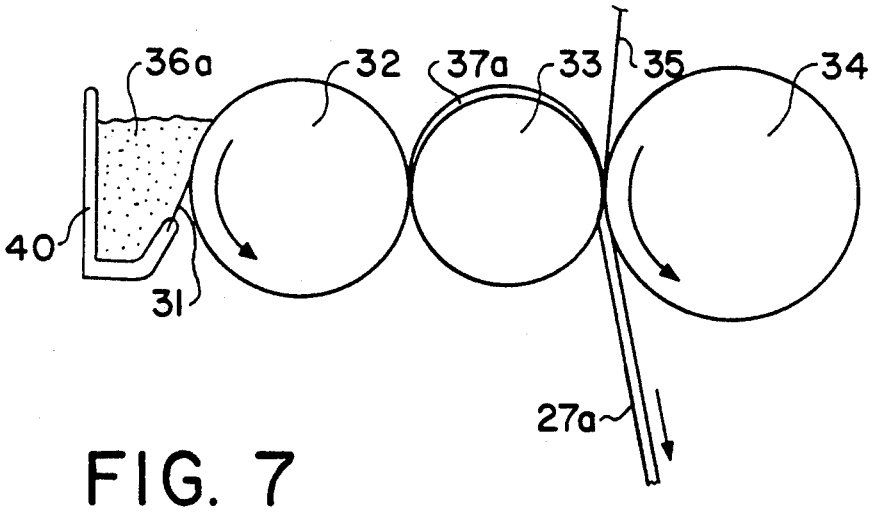
FIG. 7 is a schematic drawing of the flexographic printing process.

The flexographic printing process used in the present invention is preferably repeated twice to form coating 27. Thus, layer 27 will preferably comprise an inner layer 27*a* and an outer layer 27*b*. As shown in FIG. 7, the flexographic printing process typically employs a fountain 40; a reverse-angle doctor blade assembly 31 attached to fountain 40, an anilox metering roll 32 in operative relation with fountain 40 and doctor blade 31; a plate cylinder 33 in operative relation with anilox metering roll 32; and an impression cylinder 34 which presses web 35 between impression cylinder 34 and plate cylinder 33.

As discussed above, coating 27 will be a styrenated acrylic water based emulsion 36. However, because emulsion 37 typically has a viscosity greater than 3 minutes through a No. 2 Zahn cup, it is desirable to reduce this viscosity before forming inner layer 27*a* and outer layer 27*b*. Thus, on the first pass of web 35 through the flexographic printing process to form inner layer 27*a*, fountain 40 will be filled with a fluid 36*a* which comprises water and emulsion 36. Fluid 36*a* has a viscosity between 55 to 60 seconds through the same No. 2 Zahn cup. Similarly, on the second pass of web 35 to form outer layer 27*b*, fountain 30 will be filled with a fluid 36*b* which comprises water and emulsion 36. Fluid 36*b* has a viscosity of 25 seconds through the same Zahn cup.

Figure 8:
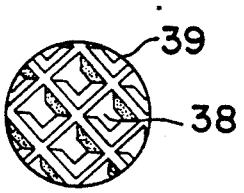
FIG. 8 is an enlarged detail view of the anilox metering roll used in the flexographic printing distribution system.

As shown in FIG. 8, small indentations or cells 38 are engraved into the entire surface of a flexible rubber plate 39 by means of well-known plastic molding techniques. The average number of cells 38 per square inch of surface area is typically about 100,000, but, depending on the application intended, the number of cells 38 may vary from 30,000 to 300,000. Rubber plate 39 is then affixed to the circumference of anilox metering roll 32 with the opening of cells 38 extending radially outward.

The flexographic system operates by rotating anilox metering roll 32 against fluid 36*a* in fountain 40, thereby filling cells 38 on the surface of anilox roll 32 with fluid 36*a*. As anilox roll 32 rotates, doctor blade 31 shaves excess fluid 36*a* off the surface of anilox roll 32. Anilox roll 32, which rotates in contact with plate cylinder 33, then transfers the contents of cells 38 to the surface of plate cylinder 33 to form a layer of fluid 37*a* thereof. Since the size of cells 38 are accurately controlled, the density of fluid 36*a* on plate cylinder 33 is relatively uniform to within a variation of about 2% or less.

Plate cylinder 33 continues to rotate, thereby transferring the uniform layer of fluid 37*a* to web 35. The complementary rotation of impression cylinder 34, which squeezes web 35 between plate cylinder 33 and impression cylinder 34, secures the layer of fluid 37*a* to web 35 to form inner layer 27*a* on web 35.

Figure 9:
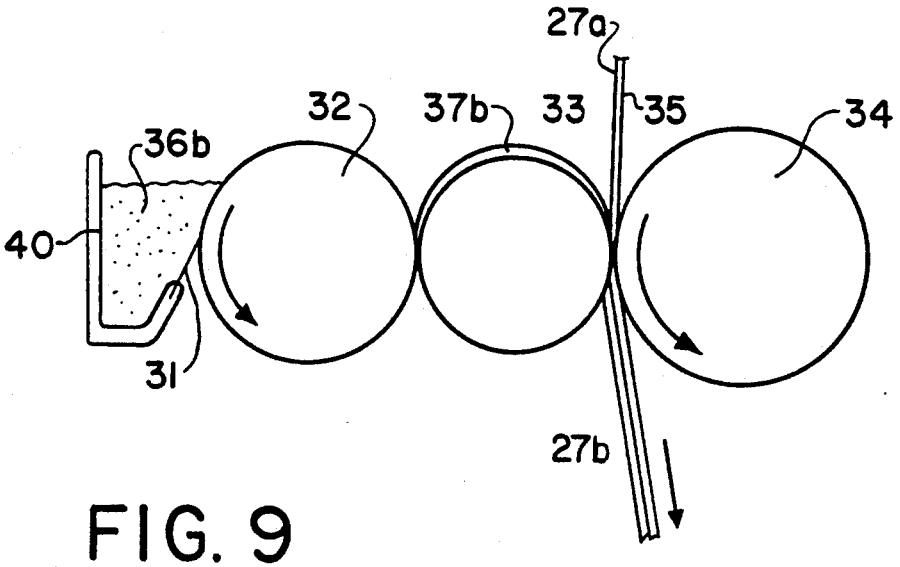
FIG. 9 is an additional schematic drawing of the flexographic printing process.

As shown in FIG. 9, the flexographic printing process described above is then repeated with fluid 36*b* in fountain 40 to form layer 27*b* on top of inner layer 27*a*, thereby forming coating 27 on web 35. Web 35 will then pass to a cutting or stamping station where 35 will be formed into outer layers 11*b*, 12*b*. Thus, coating layer 27, which will be on the outer surfaces of folder 10, will prevent liquids from penetrating into folder 10 and will prevent disfigurement of folder 10 due to repeated labeling and relabeling.

The strength and resistance to tearing of expandable folder 10 according to the present invention was compared to other expandable folders available on the market. The following test results clearly and unequivocally demonstrate the superior durability and enhanced strength of the expandable folder of the present invention.

Front and Rear Panel Member Pull Test

This first test demonstrates the enhanced resistance to tearing of gusset 14 from front panel member 11 or rear panel member 12 when folder 10 is stretched after gusset 14 is already fully expanded.

In this test, a rectangular metal box with a hinged top was fit into different types of expandable folders. The box was as wide as the folders when the folders were fully expanded and was as long as the distance between the points of connection of the gusset with the front and rear panel members. A pull ring was attached to the top of the box, which extended out of the folder, opposite the hinge, and a scale was attached to the pull ring.

A pulling force was then applied to the pull ring through the scale. This pulling force opened the top of the box and pulled the front panel member and rear panel member away from the gusset, thereby simulating hyper-expansion of the folder. The folders were considered to have failed when the gusset separated from the front or rear panel member, and the force required to cause the failure was measured with the scale.

The results of this test are tabulated below:

| Manufacturer | Product | Test Results |
|---|---|---|
| Company A | File pocket with conventional 3½" paper gusset | Failed at 9 lbs. |
| Company A | File pocket with conventional 3½" cloth gusset | Failed at 8 lbs. |
| Company A | File pocket with newly developed 3½" Tyvek ® gusset | Failed at 21 lbs. |
| Company B | File pocket with conventional 3½" paper gusset | Failed at 12 lbs. |
| Company B | File pocket with conventional 3½" Tyvek ® gusset | Failed at 10 lbs. |
| Company B | File pocket with reinforced 3½" gusset according to the present invention | No failure at 50 lbs. |
| Company B | Expansion wallet with reinforced 3½" gusset according to the present invention | No failure at 50 lbs. |

Corner Rub Test

The corner rub test demonstrates the increased wear resistance of corner 22 of folder 10.

In this test, various expandable folders were filled with nine ponds of paper. An oscillating arm rubbed the loaded folder with an abrasive crocus cloth at a rate of 654 strokes per hour and at a fifteen degree angle with respect to the bottom of the folder. The cloth was changed every 2500 cycles. The folders were considered to have failed when a hole appeared in the corner.

The results of the test are tabulated below:

| Manufacturer | Product | Test Results |
|---|---|---|
| Company A | Conventional 3½" Tyvek ® gusset | Hole developed at 6000 cycles |
| Company A | Conventional 3½" cloth gusset | Hole developed at 4000 cycles |
| Company B | Conventional 3½" Tyvek ® gusset | Hole developed at 11000 cycles |
| Company B | Reinforced 3½" gusset according to the present invention | No hole at 17000 cycle<br>Hole developed at >44,000 cycles |

Drop Test

This test demonstrates the enhanced load bearing capacity and improved loaded performance of folder 10.

Various folders were filled with ten pounds of paper and dropped from a height of four feet. The folders were dropped on the gussets, on the corners, on the front panel member, and on the rear panel member. The folders were considered to have failed when they split or tore.

The results of the test are tabulated below:

| Manufacturer | Product | Test Results |
|---|---|---|
| Company B | Conventional 3½" Tyvek ® gusset | Failure in each drop test |
| Company B | Conventional 3½" paper gusset | Failure in each drop test |
| Company B | Reinforced 3½" gusset according to the present invention | No failure after 14 total drops (5 on gussets, 5 on corner 4 on panel members) |

Repeated Mechanical Openings

This test demonstrates the enhanced durability in use of folder 10.

An arm which had two diametrically opposed cams thereon was supported between two leaf springs. Attached to each spring was a plate that was as high as the front and rear panel member and as long as the distance between the points of connection of the gusset with the front and rear panel member.

This apparatus was placed inside different types of expandable folders with the plates flush against the front and rear panel members. The low portions of the cam lobes were against the leaf springs when the expandable folder was in its relaxed position.

The arm was then rotated at a rate of 9.6 revolutions per minute, thereby causing the cam lobes to open and close the springs 19.2 times per minute. The springs, through the plates, thereby fully expanded and relaxed the expandable folder to simulate use of the folder. The folders were considered to have failed when the gussets separated from the front or rear panel member.

The results of the tests are tabulated below:

| Manufacturer | Product | Test Results |
|---|---|---|
| Company B | Conventional 3½" paper gusset | Failed within 24 hrs. |
| Company B | Reinforced 3½" gusset according to the present invention | No failure after 72 hrs. of continuous testing |

Gusset Pull Test

This test demonstrates the enhanced resistance to separation of gusset 14 from the front or rear panel members 11, 12 when a pulling force is applied to gusset 14 in a direction parallel to the front or rear panel member 11, 12.

In this test, various types of expandable folders were filled to capacity. A clamp was then attached to the upper edge of the fully expanded gusset, and a pull ring was attached to the clamp through a scale.

A pulling force which pulled the gusset away from the panel member was then applied to the gusset through the pull ring. The folder was considered to have failed when the gusset tore or was pulled away from the front or rear panel member. The force required to cause the failure was measured with the scale.

The results of this test are tabulated below.

| Manufacturer | Product | Test Results |
|---|---|---|
| Company A | Expansion wallet with 3½" conventional cloth gusset | Failed at 32 lbs. |
| Company A | Expansion wallet with 3½" conventional paper gusset | Failed at 40 lbs. |
| Company B | File pocket with conventional 3½" paper gusset | Failed at 27 lbs. |
| Company B | File pocket with conventional 3½" Tyvek ® gusset | Failed at 31 lbs. |
| Company B | File pocket with reinforced 3½" gusset according to the present invention | No failure with pulling forces greater than 50 lbs. |
| Company B | Expansion wallet with 3½" conventional paper gusset | Failed at 28 lbs. |
| Company B | Expansion wallet with reinforced 3½" gusset according to the present invention | No failure with pulling forces of 50+ lbs. |

Gusset Tear Test

The gusset tear test demonstrated the increased resistance to tearing of gusset 14.

This test employed a method and apparatus known as the Elmendorf-type method to measure the internal tearing resistance of paper. The Elmendorf method measures the force perpendicular to a plane of paper that is required to tear sheets of paper through a specified distance after a tear has been started. A complete description of the method and apparatus is disclosed in *Tappi T* 414 *Test Methods*, Vol. 1, pages 1–6 (1991), which is incorporated herein by reference.

The results of the test are tabulated below:

| Manufacturer | Product | Test Results |
|---|---|---|
| Company A | Conventional 3½" paper gusset | Failed at 700 grams-force |
| Company B | Conventional 3½" paper gusset | Failed at 750 grams-force |
| Company B | Conventional 3½" Tyvek ® gusset | Failed at 770 grams-force |
| Company B | Reinforced 3½ gusset according to the present invention | No failure at greater than 1,000 grams-force |

Accordingly, the above tests demonstrate the greatly enhanced durability, strength, and resistance to tearing of the expandable folder of the present invention as compared to other expandable folders. Folder 10 has increased resistance to failure when gusset 14 is hyper-expanded, when it is picked up by either front panel member 11 or rear panel member 12, or when it is dropped. Further, gusset 14 has increased resistance to separation from front panel member 11 or rear panel member 12 when gusset 14 is pulled, and gusset 14 has increased resistance to tearing. Finally, folder 10 has increased resistance to penetration of liquids and corners 23 have increased resistance to wear. Applicants have designed the expandable folder 10 of the present invention to include these features so that its useful life will be significantly prolonged.

It is also contemplated by the present invention that reinforcements 20, 21, 22, 24, 26, 27, 29, 30 be used with other types of expandable folders, namely elastic-tie expandable folders, filing jackets, hanging folders, and wallet-type folders. Further, individual compartments or pockets may be formed within folder 10, as disclosed in U.S. Pat. No. 1,698,841.

According to the provisions of the Patent Statutes, I have explained the principle, preferred construction and mode of operation of my invention and have illustrated and described what I now consider to represent its best embodiments. However, it should be understood, that within the scope of the appended claims, the invention may also be practiced otherwise than as specifically illustrated and described.

We claim:

1. An expandable folder, comprising:

a front panel member having first and second surfaces;

a rear panel member having first and second surfaces;

a gusset member connecting peripheral portions of the front and rear panel members so that the panel members face each other to form, respectively, front and rear inner boundaries of the folder; and interior reinforcing means applied to peripheral portions of the first surface of the front and rear panel members adjacent to at least a portion of the connection between the gusset member and panel member peripheral portions but not upon the gusset member for preventing separation of the front and rear panel members from the gusset member when the folder is used.

2. The expandable folder of claim 1, wherein each of the front and rear panel members has opposed sides and a bottom, and wherein the gusset member has top, bottom and opposed sides, wherein the bottom sides of the gusset member are respectively connected to the bottom of the front and rear panel member and along at least a portion of the sides thereof, and wherein the reinforcing means extends along a portion of the sides of the front and rear panel members on the first surfaces thereof.

3. The expandable folder of claim 2 wherein the gusset member is made of paper having a layer of thermoplastic material on one side thereof, and the reinforcing means is a thermoplastic material which is secured to the panel members.

4. The expandable folder of claim 3 wherein the first and second surfaces of the front and rear panel members, respectively, form inner layers of those m embers, and further comprising front and rear outer layers which are secured to the front and rear inner layers to form the front and rear panel members.

5. The expandable folder of claim 4 wherein the gusset member comprises a plurality of folds with terminal folds on each side of the gusset member being wider than the other folds, with the terminal folds connected to the front and rear panel members in between the inner and outer layers thereof.

6. The expandable folder of claim 5 wherein the inner layer of the front panel member and the outer layers of the front and rear panel members are each made of red wallet or red rope while the inner layer of the rear panel member is made of manila.

7. The expandable folder of claim 6 wherein the gusset member further comprises reinforcement means extending along and over the top sides thereof to enhance the tear resistance of the gusset member.

8. The expandable folder of claim 7 wherein the rear panel member has a greater height than the front panel member, and further comprising a coating on the outer surface of the outer layers of the front and rear panel members to resist permeation by moisture, and wherein the terminal folds of the gusset member are at least twice as wide as the other folds or at least $\frac{7}{8}''$.

9. The expandable folder of claim 2, wherein the gusset member includes reinforcement means extending along at least one top side of the gusset member to enhance the tear resistance of the gusset member when the folder is used.

10. The expandable folder of claim 1, wherein the gusset member includes at lest one corner, and further comprising reinforcing means applied to the gusset member corners and extending along at least a portion of the side and bottom of the gusset member to enhance the wear resistance of the folder.

11. The expandable folder of claim 1, wherein the gusset member comprises a sheet having a plurality of accordion-like folds, with terminal folds of the sheet being wider than the other folds, and the terminal folds are connected to the front and rear panel members to enhance the connection therebetween.

12. The expandable folder of claim 1, which further comprises a coating on the second surfaces of the front and rear panel members to improve the resistance of the folder to penetration of liquids to protect the folder from disfigurement.

13. The expandable folder of claim 1, wherein the gusset member has an inner surface and outer surface, and which further comprises reinforcement means affixed to the outer surface of the gusset member to enhance the wear resistance of the folder.

14. An expandable folder, comprising:

a front panel member having first and second surfaces, opposite sides and a bottom;

a rear panel member having first and second surfaces, opposite sides and a bottom;

a gusset member having a bottom, opposite sides and two corners for connecting peripheral portions of the front and rear panel members so that the panel members face each other to form front and rear inner boundaries of the folder, wherein the bottom and opposite sides of the gusset member are respectively connected to the bottom of the front and rear panel members and along at least a portion of the sides thereof; and reinforcing means applied only to portions of the gusset member at the corners thereof and extending along a portion of the sides and bottom of the gusset member to enhance the wear resistance of the folder.

15. The expandable folder of claim 14, wherein the gusset member comprises a sheet having a plurality of accordion-like folds, with terminal folds of the sheet being wider that the other folds, and the terminal folds are connected to the front and rear panel members to enhance the connection therebetween.

16. The expandable folder of claim 15 which further comprises interior reinforcing means applied to the first surfaces of the front and rear panel members adjacent to at least a portion of the connection between the sides of the gusset member and panel member peripheral portions for preventing separation of the front and rear panel members from the gusset member when the folder is used.

17. The expandable folder of claim 14, wherein the gusset member includes reinforcement means extending along at least one top portion of the gusset member to enhance the tear resistance of the gusset member when the folder is used.

18. The expandable folder of claim 14, which further comprises a coating on the second surfaces of the front and rear panel members to improve the resistance of the folder to penetration of liquids to protect the folder from disfigurement.

19. The expandable folder of claim 14, wherein the gusset member further has an inner surface and an outer surface, and which further comprises reinforcement means affixed to the outer surface of the gusset member to enhance the wear resistance of the folder.

20. The expandable folder of claim 19 wherein the reinforcement means applied to the outer surface of the gusset member comprises a thermoplastic material which covers the entire outer surface of the gusset, and the reinforcement means applied to each gusset member corner comprises a strip of thermoplastic material which is applied to the thermoplastic material on the outer surface of the gusset.

21. An expandable folder comprising:

a front panel member having first and second surfaces, opposite sides and a bottom;

a rear panel member having first and second surfaces, opposite sides and a bottom;

a gusset member having a top, bottom, opposite sides, and two corners, for connecting peripheral portions of the front and rear panel members so that the panel members face each other to form front and rear inner boundaries of the folder, the bottom and opposite sides of the gusset member respectively connected to the bottom of the front and rear panel members and along at least a portion of the sides thereof;

interior reinforcing means applied to peripheral portions of the first surfaces of the front and rear panel members adjacent to at least a portion of the connection between the gusset member and panel member peripheral portions but not upon the gusset member for preventing separation of the front and rear panel members from the gusset member when the folder is used; and a coating on the second surfaces of the front and rear panel members to improve the resistance of the folder to penetration of liquids to protect the folder from disfigurement.

22. The expandable folder of claim 21 wherein the coating is formed from a styrenated acrylic water-based emulsion which is applied to the second surfaces of the panels.

23. The expandable folder of claim 21, wherein the gusset member further has an inner surface and an outer surface, and which further comprises reinforcement means affixed to the outer surface of the gusset member to enhance the wear resistance of the folder.

24. The expandable folder of claim 21 which further comprises reinforcing means applied to the gusset member corners and extending along at least a portion of the side and bottom of the gusset member to enhance the wear resistance of the folder.

25. The expandable folder of claim 21, wherein the gusset member comprises a sheet of having a plurality of accordion-like folds, with terminal folds of the sheet being wider than the other folds, and the terminal folds are connected to the front and rear panel members to enhance the connection therebetween.

26. The expandable folder of claim 21, wherein the gusset member includes reinforcement means extending along and over at least one top portion of the gusset member to enhance the tear resistance of the gusset member when the folder is used.

27. An expandable folder comprising:

a front panel member having first and second layers, opposite sides and a bottom, wherein the first and second layers are secured together;

a rear panel member having first and second layers, opposite sides and a bottom, wherein the first and second layers are secured together;

a gusset member having a bottom, opposite sides, and two corners for connecting peripheral portions of the first and rear panel members so that the first layers of the panel members face each other to form front and rear inner boundaries of the folder, the bottom and opposite sides of the gusset member respectively connected to the bottom of the front and rear panel members and along at least portions of the sides thereof;

wherein the gusset member comprises a sheet having a plurality of accordion-like folds, with (a) terminal folds of the sheet being provided at least on the sides of the gusset member and being wider than the other folds, (b) the terminal folds being secured to the front and rear panel members in between the first and second layers thereof, and (c) the first layers of the front and rear panel members extending to substantially the outermost end of the first and last fold, respectively.

28. The expandable folder of claim 27 wherein the inner layer of the front panel member and the outer layers of the front and rear panel members are each made of red wallet or red rope, while the inner layer of the rear panel member is made of manila, and wherein the terminal folds of the gusset member are at least twice as wide as the other folds or at least $\frac{7}{8}$".

29. The expandable folder of claim 28 wherein the gusset member further comprises reinforcement means extending along and over the top sides thereof to enhance the tear resistance of the gusset member, and further wherein the first layers of the front and rear panel members extend to the outermost end of the first and last gusset fold, respectively.

30. The expandable folder of claim 27, wherein the gusset member includes reinforcement means extending along and over at least one top portion of the gusset member to enhance the tear resistance of the gusset member when the folder is used.

31. The expandable folder of claim 27 which further comprises reinforcing means applied to the gusset member corners and extending along at least a portion of the side and bottom of the gusset member to enhance the wear resistance of the folder.

32. The expandable folder of claim 27 which further comprises interior reinforcing means applied to the front and rear panel members adjacent at least a portion of the connection between the sides of the gusset member and panel member peripheral portions for preventing separation of the front and rear panel members from the gusset member when the folder is used.

33. The expandable folder of claim 27, wherein the gusset member further has an inner surface and an outer surface, and which further comprises reinforcement means affixed to the outer surface of the gusset member to enhance the wear resistance of the folder.

34. The expandable folder of claim 27, which further comprises a coating on the second surfaces of the front and rear panel members to improve the resistance of the folder to penetration of liquids to protect the folder from disfigurement.

35. An expandable folder comprising:

a front panel member having first and second layers, opposite sides and a bottom;

a rear panel member having first and second layers, opposite sides and a bottom;

a gusset member having a top portion, a bottom, opposite sides, and two corners for connecting peripheral portions of the front and rear panel members so that the first layers of the panel members face each other to form front and rear inner boundaries of the folder, the bottom and opposite sides of the gusset member respectively connected to the bottom of the front and rear panel members and along at least a portion of the sides thereof; and reinforcement means extending over at least the top portion of the gusset member to enhance the tear resistance of the gusset member when the folder is used; wherein the gusset member comprises a sheet having a plurality of accordion-like folds, with (a) terminal folds of the sheet being provided at least on the sides of the gusset member and being wider than the other folds, (b) the terminal folds being secured to the front and rear panel members in between the first and second layers thereof, and (c) the first layers of the front and rear panel members extending to substantially the outermost end of the first and last fold, respectively.

36. The expandable folder of claim 35 which further comprises interior reinforcing means applied to the front and rear panel members adjacent to at least a portion of the connection between the sides of the gusset member and panel member peripheral portions for preventing separation of the front and rear panel members from the gusset member when the folder is used.

37. The expandable folder of claim 35 which further comprises reinforcing means applied to the gusset member corners and extending along at least a portion of the side and bottom of the gusset member to enhance the wear resistance of the folder.

38. The expandable folder of claim 35, wherein the gusset member further has an inner surface and an outer surface and which further comprises reinforcement means affixed to the outer surface of the gusset member to enhance the wear resistance of the folder.

39. The expandable folder of claim 35, which further comprises a coating on the second surfaces of the front and rear panel members to improve the resistance of the folder to penetration of liquids to protect the folder from disfigurement.

40. The expandable folder of claim 35 wherein the gusset member is made of paper having a layer of thermoplastic material on one side thereof, and wherein each of the first and second layers of the front and rear panel members, respectively, are secured together to form the front and rear panel members, and further wherein the first layers of the front and rear panel members extend to the outermost end of the first and last gusset fold, respectively.

41. The expandable folder of claim 35 wherein the inner layer of the front panel member and the outer layers of the front and rear panel members are each made of red wallet or red rope, while the inner layer of the rear panel member is made of manila, and further wherein the terminal folds of the gusset member are at least twice as wide as the other folds or at least $\frac{7}{8}$".

42. The expandable folder of claim 41 wherein the rear panel member has a greater height than the front panel member, and further comprising a coating on the outer surface of each of the outer layers of the front and rear panel members to resist permeation by moisture.

43. The expandable folder of claim 35 wherein the reinforcement means extending over at least the top portion of the gusset member comprises a sheet of paper which is reinforced with thermoplastic material and which is folded over the top edge and onto the sides of the gusset member.

* * * * *